US007681980B2

(12) United States Patent
Cai et al.

(10) Patent No.: US 7,681,980 B2
(45) Date of Patent: Mar. 23, 2010

(54) INK IDENTIFICATION AND DETECTION SYSTEM WITH INK FOR USE THEREWITH

(75) Inventors: Xiaorong Cai, Lexington, KY (US); Mahesan Chelvayohan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 245 days.

(21) Appl. No.: 11/934,142

(22) Filed: Nov. 2, 2007

(65) Prior Publication Data

US 2009/0115804 A1 May 7, 2009

(51) Int. Cl.
*B41J 29/393* (2006.01)

(52) U.S. Cl. ..... 347/19

(58) Field of Classification Search ..... 347/9–11, 347/19, 95, 100
See application file for complete search history.

(56) References Cited

U.S. PATENT DOCUMENTS

| | | | | |
|---|---|---|---|---|
| 6,028,320 | A * | 2/2000 | Uhling | 250/559.44 |
| 7,470,731 | B2 * | 12/2008 | Sanchez et al. | 523/160 |
| 2008/0149894 | A1 * | 6/2008 | Auslander et al. | 252/301.16 |

* cited by examiner

*Primary Examiner*—Lamson D Nguyen

(57) ABSTRACT

An ink identification and detection system includes an imaging apparatus. An ink tank is mounted to the imaging apparatus. The ink tank has a transparent portion. An ink is contained in the ink tank. The ink includes a fluorescing material. An ink detection device is communicatively coupled to a controller. The ink detection device is configured to emit light in a non-visible spectrum of light through the transparent portion to the ink, and is configured to detect light in a visible or near-infrared spectrum of light emitted through the transparent portion by the fluorescing material in the ink. The ink detection device supplies a signal representing the detected light to the controller for identifying the ink.

14 Claims, 4 Drawing Sheets

INK IDENTIFICATION AND DETECTION SYSTEM WITH INK FOR USE THEREWITH

CROSS-REFERENCE TO RELATED APPLICATIONS

None.

MICROFICHE APPENDIX

None.

GOVERNMENT RIGHTS IN PATENT

None.

BACKGROUND OF THE INVENTION

1. Field of the Invention

The present invention relates to ink printing systems, and, more particularly, to an ink identification and detection system, with ink for use therewith.

2. Description of the Related Art

An ink jet imaging apparatus, such as an ink jet printer, forms an image on a print medium, such as paper, by ejecting ink onto the print medium. Such an ink jet printer may include a reciprocating printhead carrier that transports one or more printheads across the print medium along a bi-directional scanning path defining a print zone of the printer. Each printhead includes a nozzle array having a plurality of ink jetting nozzles, with at least one micro-fluid ejection device (resistive heater, piezoelectric device, etc.) associated with each nozzle. Each printhead is in fluid communication with an ink tank containing ink.

In some printing systems, the ink tank is integrated with at least one printhead to form an ink jet printhead cartridge. In other printing systems, the ink tank is separate from, or separable from, the printhead, wherein the ink tank may be carried by the printhead carrier, or alternatively, the ink tank is located off-carrier.

A color printhead, for example, may include multiple nozzle arrays, with each nozzle array configured to selectively eject ink of a particular color of a plurality of colors of ink, e.g., cyan, magenta, yellow, and/or diluted forms thereof. Each color of ink is contained in an ink tank containing ink of the particular color.

A monochrome printhead, for example, may include one or more nozzle arrays configured to selectively eject monochrome ink, e.g., black ink. The monochrome ink is contained in an ink tank containing the monochrome ink.

What is needed in the art is an ink identification and detection system, with ink for use therewith.

SUMMARY OF THE INVENTION

The present invention provides an ink identification and detection system, with ink for use therewith.

The invention, in one form thereof, is directed to an ink identification and detection system. The system includes an imaging apparatus. An ink tank is mounted to the imaging apparatus. The ink tank has a transparent portion. An ink is contained in the ink tank. The ink includes a fluorescing material. An ink detection device is communicatively coupled to a controller. The ink detection device is configured to emit light in a non-visible spectrum of light through the transparent portion to the ink, and is configured to detect light in a visible or near-infrared spectrum of light emitted through the transparent portion by the fluorescing material in the ink. The ink detection device supplies a signal representing the detected light to the controller for identifying the ink.

The invention, in another form thereof, is directed to an ink for use in printing with an imaging apparatus. The ink includes an ink selected from a group consisting of a pigment ink and a dye ink. A fluorescing material is contained in the ink, which when exposed to ultraviolet light emits light in a visible or near-infrared spectrum of light.

The invention, in another form thereof, is directed to an imaging apparatus. The imaging apparatus includes a print engine configured to mount at least one ink tank. A controller is communicatively coupled to the print engine. An ink detection device is communicatively coupled to the controller. The ink detection device is configured to detect light in a visible or near-infrared spectrum of light emitted by a fluorescing material in ink. The ink detection device supplies a signal representing the detected light to the controller for identifying the ink.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
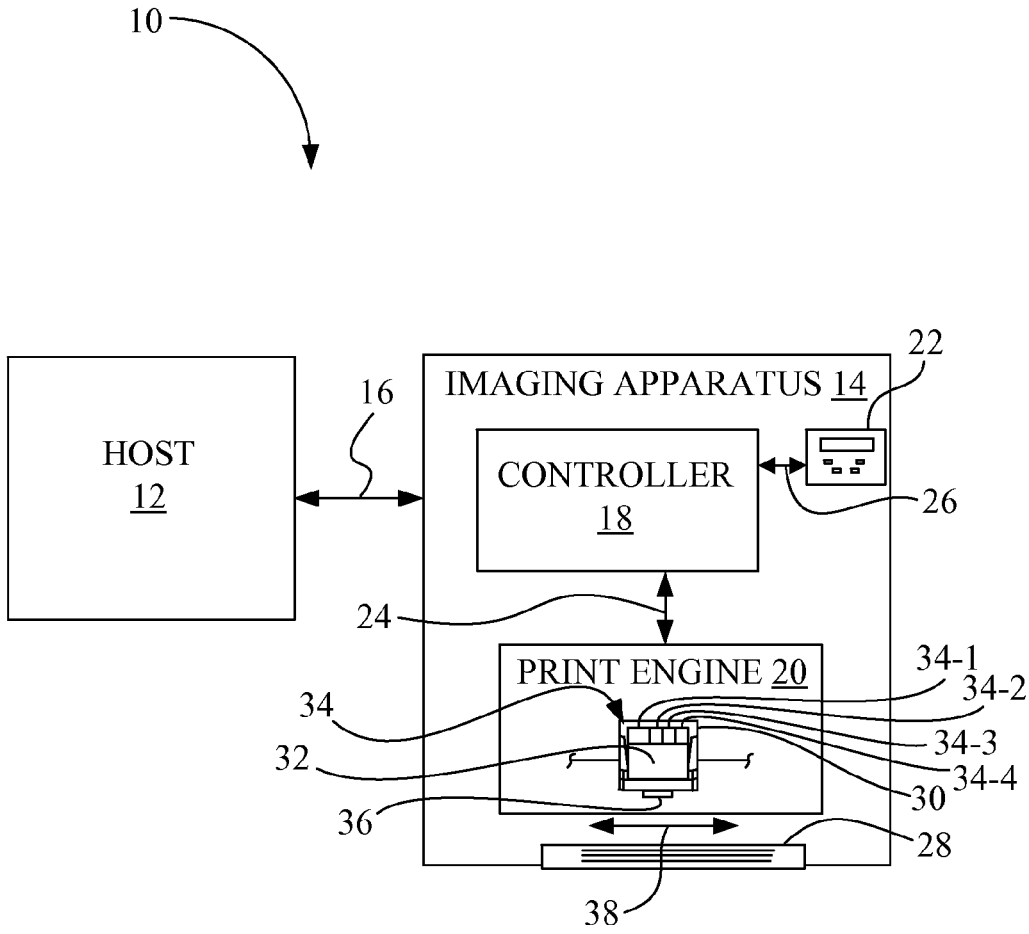
FIG. 1 is a diagrammatic depiction of an exemplary embodiment of an imaging system including an ink detection device, in accordance with an aspect of the present invention.

Referring to FIG. 1, there is shown a diagrammatic depiction of an imaging system 10 embodying the present invention. Imaging system 10 may include a host 12 and an imaging apparatus 14. Imaging apparatus 14 communicates with host 12 via a communications link 16. Communications link 16 may be established by a direct cable connection, wireless connection or by a network connection such as for example an Ethernet local area network (LAN).

Alternatively, imaging apparatus 14 may be a standalone unit that is not communicatively linked to a host, such as host 12. For example, imaging apparatus 14 may take the form of an all-in-one, i.e., multifunction, machine that includes standalone copying and facsimile capabilities, in addition to optionally serving as a printer when attached to a host, such as host 12.

Host 12 may be, for example, a personal computer including an input/output (I/O) device, such as keyboard and display monitor. Host 12 further includes a processor, input/output (I/O) interfaces, memory, such as RAM, ROM, NVRAM, and a mass data storage device, such as a hard drive, CD-ROM and/or DVD units. During operation, host 12 may include in its memory a software program including program instructions that function as an imaging driver, e.g., printer driver software, for imaging apparatus 14. Alternatively, the imaging driver may be incorporated, in whole or in part, in imaging apparatus 14.

In the embodiment of FIG. 1, imaging apparatus 14 includes a controller 18, a print engine 20 and a user interface 22.

Controller 18 includes a processor unit and associated memory, and may be formed as an Application Specific Integrated Circuit (ASIC). Controller 18 communicates with print engine 20 via a communications link 24. Controller 18 communicates with user interface 22 via a communications link 26. Communications links 24 and 26 may be established, for example, by using standard electrical cabling or bus structures, or by wireless connection.

Print engine 20 may be, for example, an ink jet print engine configured for forming an image on a sheet of print media 28, such as a sheet of paper, transparency or fabric. Print engine 20 may include, for example, a reciprocating printhead carrier 30 and an ink detection device 32.

In the present embodiment, printhead carrier 30 is configured to mount a plurality of removable ink tanks 34. Printhead carrier 30 is mechanically and electrically configured to mount and carry at least one printhead 36 that includes at least one ink jet micro-fluid ejection device. Printhead carrier 30 transports removable ink tanks 34 and printhead 36 in a reciprocating manner in a bi-directional main scan direction, i.e., axis, 38 over an image surface of the sheet of print media 28 during a printing operation. Alternatively, the removable ink tanks 34 may be located off-carrier, i.e., remote from printhead carrier 30, and connected to printhead 36 by a fluid conduit system.

The plurality of removable ink tanks 34 may be made, for example, from plastic. The plurality of ink tanks 34 are individually identified as ink tanks 34-1, 34-2, 34-3 and 34-4, and may include a monochrome ink tank 34-1 containing black ink, and three color ink tanks 34-2, 34-3, and 34-4 containing cyan, magenta, and yellow inks, respectively. In accordance with the present invention, each of the monochrome and color inks include a fluorescing material that is exposed to and absorbs light in the non-visible spectrum of light (e.g., ultraviolet (UV), i.e., below about 400 nanometers (nm) wavelength) and based on an excitation by the absorbed light, emits light in the visible or near-infrared (IR) spectrum of light (i.e., about 400 nm to 1000 nm), which will be described in more detail below. Here, the term "about" means plus or minus five percent. In general, in accordance with the present invention the quantity and/or type of fluorescing material contained in each of the inks may be used for ink identification.

Figure 2:
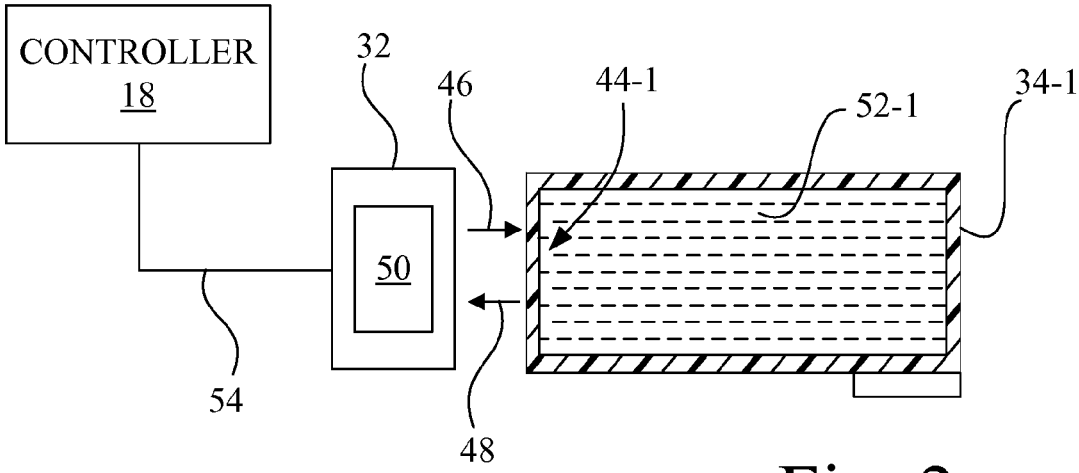
FIG. 2 is a diagrammatic depiction of the ink detection device of FIG. 1 having a detection unit that emits light in the non-visible spectrum of light into the ink contained in an ink tank, in accordance with an aspect of the present invention.

Referring to FIG. 2, ink tank 34-1 is used to illustrate the operation of the present invention. Ink tank 34-1 may be formed from transparent plastic or may include a transparent window, but in either case includes a transparent portion 44-1 that exposes the ink contained in ink tank 34-1. Ink detection device 32 is positioned to face transparent portion 44-1 of ink tank 34-1. Ink detection device 32 is configured to emit light 46 in the non-visible spectrum of light through transparent portion 44-1 to the ink contained in ink tank 34-1, and detect light 48 in the visible or near-IR spectrum of light emitted by the fluorescing material in the ink. Ink detection device 32 supplies a signal representing the detected light 48 to controller 18 for identifying the ink in ink tank 34-1. For example, the signal may be in the form of a voltage signal (analog or digital) which controller 18 compares to voltage ranges stored in a lookup table, which are associated with particular inks, from which an ink identification is made.

In the example shown in FIG. 2, ink detection device 32 includes at least one detection unit 50 that emits light 46 in the non-visible spectrum of light, which in turn is directed through a transparent portion of one or more of the plurality of ink tanks 34, e.g., through transparent portion 44-1 of ink tank 34-1. For example, light 46 is absorbed by the fluorescing material in the ink 52-1 contained in ink tank 34-1, thereby exciting the fluorescing material to emit light 48 in the visible to near-IR spectrum of light through transparent portion 44-1. The detection unit 50 of ink detection device 32 then receives the emitted light 48, and generates a signal indicative of the ink color, which in turn is supplied to controller 18 via communication link 54, e.g., a multi-conductor cable. Controller 18 then processes the signal to identify the ink, e.g., to determine the color of ink, contained in the ink tank.

Figure 3:
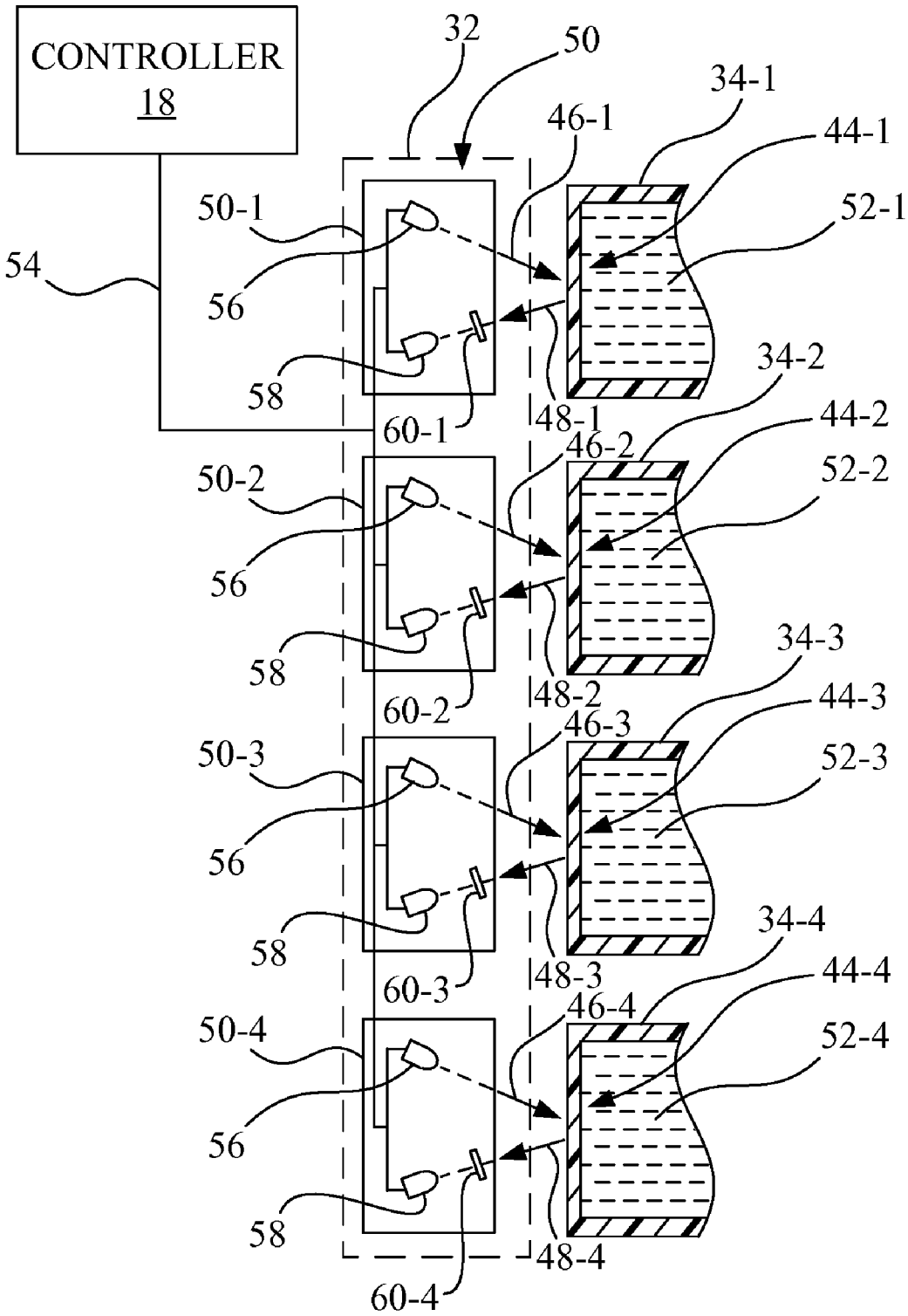
FIG. 3 shows an exemplary embodiment of the ink detection device of FIG. 1 in association with a plurality of ink tanks.

FIG. 3 is an exemplary embodiment of ink detection device 32 that includes in detection unit 50 a monochrome detection unit 50-1, and a plurality of color detection units, individually identified as cyan detection unit 50-2, a magenta detection unit 50-3, and a yellow detection unit 50-4. Each of the monochrome detection unit 50-1 and the plurality of color detection units (cyan detection unit 50-2, magenta detection unit 50-3, and yellow detection unit 50-4) are communicatively coupled to controller 18 via communication link 54. Each of ink tanks 34-1, 34-2, 34-3, and 34-4 include a respective transparent portion 44-1, 44-2, 44-3 and 44-4.

Each of the detection units 50 includes a light source 56 and a sensor 58. The respective light sources 56 generates UV light 46-1, 46-2, 46-3, 46-4, respectively, e.g., in a wavelength range of 300 nm to 400 nm, inclusive, and may be, for example, a UV light emitting diode (UV LED). In one embodiment, for example, each light source 56 is a 365 nm UV LED. Each sensor 58 may be, for example, a photo detector diode. Monochrome detection unit 50-1 includes a light filter 60-1 for filtering light 48-1 emitted by the fluorescing material in the ink 52-1 contained in ink tank 34-1. Cyan detection unit 50-2 includes a light filter 60-2 for filtering light 48-2 emitted by the fluorescing material in the cyan ink 52-2 contained in ink tank 34-2. Magenta detection unit 50-3 includes a light filter 60-3 for filtering light 48-3 emitted by the fluorescing material in the magenta ink 52-3 contained in ink tank 34-3. Yellow detection unit 50-4 includes a light filter 60-4 for filtering light 48-4 emitted by the fluorescing material in the yellow ink 52-4 contained in ink tank 34-4. The color of each of the light filters 60-1, 60-2, 60-3 and 60-4 may be selected, for example, based on the color of light emitted (i.e., the fluorescent emission) from the respective fluorescing material in the respective inks contained in respective ink tanks 34-1, 34-2, 34-3, and 34-4. Exemplary colors for light filters 60-1, 60-2, 60-3 and 60-4, include, for example, green, red, yellow, and blue.

The embodiment of FIG. 3 works for all cases, including the case where individual respective colored fluorescing material is used for each of cyan ink 52-2, magenta ink 52-3 and yellow ink 52-4, and/or monochrome ink 52-1, as well as in the case where a single invisible fluorescing material is used, for example, in each of cyan ink 52-2, magenta ink 52-3 and yellow ink 52-4, and/or monochrome ink 52-1. However, it has been recognized that in the case where, for example, a single invisible fluorescing material is used in each of cyan ink 52-2, magenta ink 52-3 and yellow ink 52-4, then only one detection unit 50, e.g., detection unit 50-2, is needed for reading each of cyan ink 52-2, magenta ink 52-3 and yellow ink 52-4, thus providing a cost savings by reducing the amount of electrical/optical detecting hardware needed to perform ink identification and/or detection.

The fluorescing material in monochrome ink 52-1 may be an invisible UV fluorescent dye or pigment colorant processed as wax emulsion, latex emulsion, or dispersion, and added to the respective ink as an additive. Alternatively, the fluorescing material in monochrome ink 52-1 may be one or more UV fluorescent colorants directly added to the ink. In one embodiment, for example, the UV fluorescing material in monochrome ink 52-1 absorbs UV light from light source (UV LED) 56 of monochrome detection unit 50-1 in the wavelengths between 250 nm to 400 nm and emits in the visible range between 500 nm to 700 nm, which may be detected by sensor 58, e.g., a clear sensor, of monochrome detection unit 50-1.

Suitable invisible UV fluorescent colorants for use as the fluorescing material in monochrome ink 52-1 and/or color inks 52-2, 52-3 and 52-4 include organic fluorescent dyes or pigments, such as derivatives of benzoxazine and benzoxazinone or complexes of rare earth elements with ligands containing beta, Diketones. Other invisible UV fluorescent colorants, such as fluorescent derivatives of dansyl chloride, coumarin, carbocyanine, naphthalamide, stilbene, squarine, perylene, xanthene, thioxanthene, thioindigoid, acridine, and anthrapyridone dyes and pigments may also be included for use as the fluorescing material in monochrome ink 52-1 and/or color inks 52-2, 52-3 and 52-4.

Example 1

Figure 4:
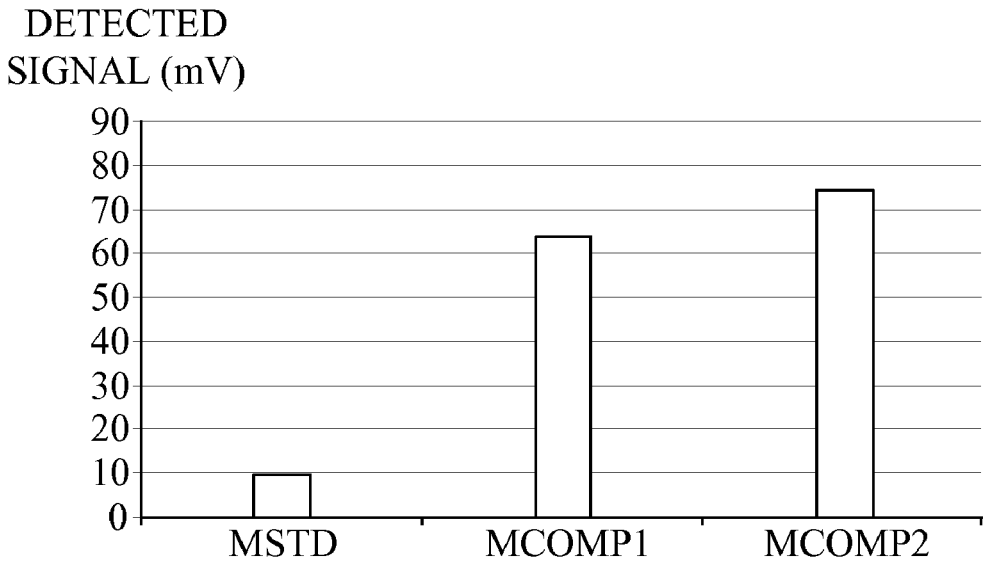
FIG. 4 is a graph showing the voltage output of a sensor of the ink detection device of FIG. 3 as a result of a comparison test using a standard monochrome ink (MSTD) that is non-fluorescing; a first comparison monochrome ink (MCOMP1) that includes fluorescing material in a first amount; and, a second comparison monochrome ink (MCOMP2) that includes fluorescing material in a second amount.

In this example, with reference to FIGS. 3 and 4, three monochrome ink tanks 34-1 are respectively filled with a standard monochrome ink (MSTD) that is non-fluorescing; a first comparison monochrome ink (MCOMP1) that includes fluorescing material in a first amount; and, a second comparison monochrome ink (MCOMP2) that includes fluorescing material in a second amount.

Monochrome ink (MCOMP1) as monochrome ink 52-1 is a Lexmark standard pigment black ink containing 0.25% Fluo-Green001 (Keyfluor Green OB-505, invisible fluorescent green dye from Keystone Aniline Corp. of Chicago, Ill., processed in Lexmark as a stable dispersion). Monochrome ink (MCOMP2) as monochrome ink 52-1 is a Lexmark standard pigment black ink containing 0.5% Fluo-Green001 (Keyfluor Green OB-505, invisible fluorescent green dye from Keystone Aniline Corp., processed in Lexmark as a stable dispersion).

Referring to FIGS. 3 and 4, the fluorescent emission of the inks MSTD, MCOMP1 and MCOMP2 in the respective ink tank 34-1 including a respective transparent portion 44-1 was measured as a voltage signal from sensor 58 of monochrome detection unit 50-1 (e.g., a photo detector diode). The average voltage readings (in millivolts (mV), ± about 5 percent in multiple samples) represent the existence of fluorescent materials in the pigment inks. As shown in FIG. 4, higher amounts of fluorescent material in the inks give higher voltage readings. In the present example, the selected light filter 60-1 of monochrome detection unit 50-1 is a green color filter #3316 from the Roscolux filter book (from Rosco Laboratories Inc.) which optimized the signal-to-noise level of the detection.

As shown in FIG. 4, the fluorescent emission from inks MCOMP1 and MCOMP2, which respectively contains 0.25% and 0.5% of Fluo-green materials, was much higher than the signal from the standard monochrome ink MSTD. As such, with the present invention, an ink may be identified by including a fluorescent material in the ink. Also, in comparing inks MCOMP1 and MCOMP2, further ink discrimination between similar inks may be made by varying the amount of fluorescent material added to the ink.

Example 2

Figure 5:
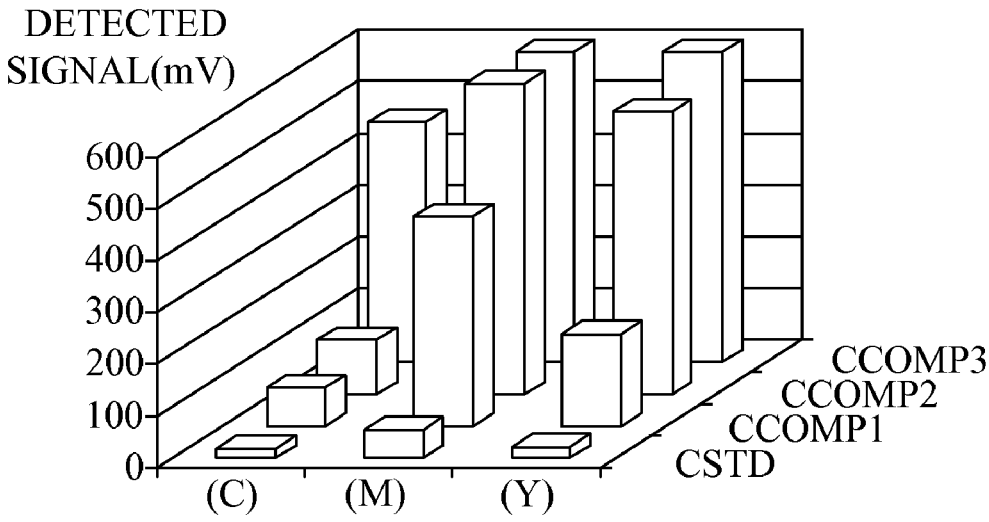
FIG. 5 is a graph showing the voltage output of a sensor of the ink detection device of FIG. 3 as a result of a comparison test using four color ink tank sets representing each of a cyan ink tank, a magenta ink tank and a yellow ink tank respectively filled with a standard color ink set (CSTD) that is non-fluorescing; a first comparison color ink set (CCOMP1) that includes fluorescing material in a first amount; a second comparison color ink set (CCOMP2) that includes fluorescing material in a second amount; and, a third comparison color ink set (CCOMP3) that includes fluorescing material in a third amount.

In this example, with reference to FIGS. 3 and 5, four color ink tank sets representing each of cyan ink tank 34-2, magenta ink tank 34-3 and yellow ink tank 34-4 are respectively filled with a standard color ink set (CSTD) that is non-fluorescing; a first comparison color ink set (CCOMP1) that includes fluorescing material in a first amount; a second comparison color ink set (CCOMP2) that includes fluorescing material in a second amount; and, a third comparison color ink set (CCOMP3) that includes fluorescing material in a third amount. In Example 2, the respective ink tanks 34-2, 34-3 and 34-4 do not contain an ink suspension foam material.

Standard color ink set (CSTD) includes a standard pigment cyan ink, a standard pigment magenta ink, and a standard pigment yellow ink.

Comparison color ink set (CCOMP1) includes the standard pigment cyan ink containing 0.1% invisible fluorescent red dispersion (Keyfluor Red OB-615, from Keystone Aniline Corp. processed in Lexmark as a stable dispersion); the standard pigment magenta ink containing 0.1% invisible fluorescent red dispersion (Keyfluor Red OB-615, from Keystone Aniline Corp., processed in Lexmark as a stable dispersion); and the standard pigment yellow ink containing 0.1% invisible fluorescent red dispersion (Keyfluor Red OB-615, from Keystone Aniline Corp., processed in Lexmark as a stable dispersion).

Comparison color ink set (CCOMP2) includes the standard pigment cyan ink containing 0.2% invisible fluorescent red dispersion (Keyfluor Red OB-615, from Keystone Aniline Corp., processed in Lexmark as a stable dispersion); the standard pigment magenta ink containing 0.2% invisible fluorescent red dispersion (Keyfluor Red OB-615, from Keystone Aniline Corp., processed in Lexmark as a stable dispersion); and the standard pigment yellow ink containing 0.2% invisible fluorescent red dispersion (Keyfluor Red OB-615, from Keystone Aniline Corp., processed in Lexmark as a stable dispersion).

Comparison color ink set (CCOMP3) includes the standard pigment cyan ink containing 0.5% invisible fluorescent red dispersion (Keyfluor Red OB-615, from Keystone Aniline Corp., processed in Lexmark as a stable dispersion); the standard pigment magenta ink containing 0.5% invisible fluorescent red dispersion (Keyfluor Red OB-615, from Keystone Aniline Corp., processed in Lexmark as a stable dispersion); and the standard pigment yellow ink containing 0.5% invisible fluorescent red dispersion (Keyfluor Red OB-615, from Keystone Aniline Corp., processed in Lexmark as a stable dispersion).

Referring to FIGS. 3 and 5, the fluorescent emission of the ink sets CSTD, CCOMP1, CCOMP2, and CCOMP3 in the four of each of ink tanks 34-2, 34-3 and 34-4 including a respective transparent portion 44-2, 44-3, 44-4 was measured as a voltage signal from sensor 58 of color detection units 50-2, 50-3, and 50-4, respectively (e.g., a photo detector diode). In the present example, the selected light filter for each of light filters 60-2, 60-3 and 60-4 of color detection units 50-2, 50-3 and 50-4 was a red filter. The average voltage readings (in millivolts (mV), ± about 5 percent in multiple samples) represent the existence of fluorescent materials in the color inks. As shown in FIG. 5, higher amounts of fluorescent material in the inks give higher voltage readings.

As such, with the present invention, an ink may be identified by including a fluorescent material in the ink. Also, ink discrimination between inks of the same color, or as between inks of different color, may be made by varying the amount of fluorescent material added to the ink.

Example 3

Example 3 uses the same ink set formulations as Example 2, and thus for brevity will not repeated here. In Example 3, however, the respective ink tanks 34-2, 34-3 and 34-4 contain an ink suspension foam material, whereas in Example 2, the respective ink tanks 34-2, 34-3 and 34-4 did not contain the ink suspension foam material.

Figure 6:
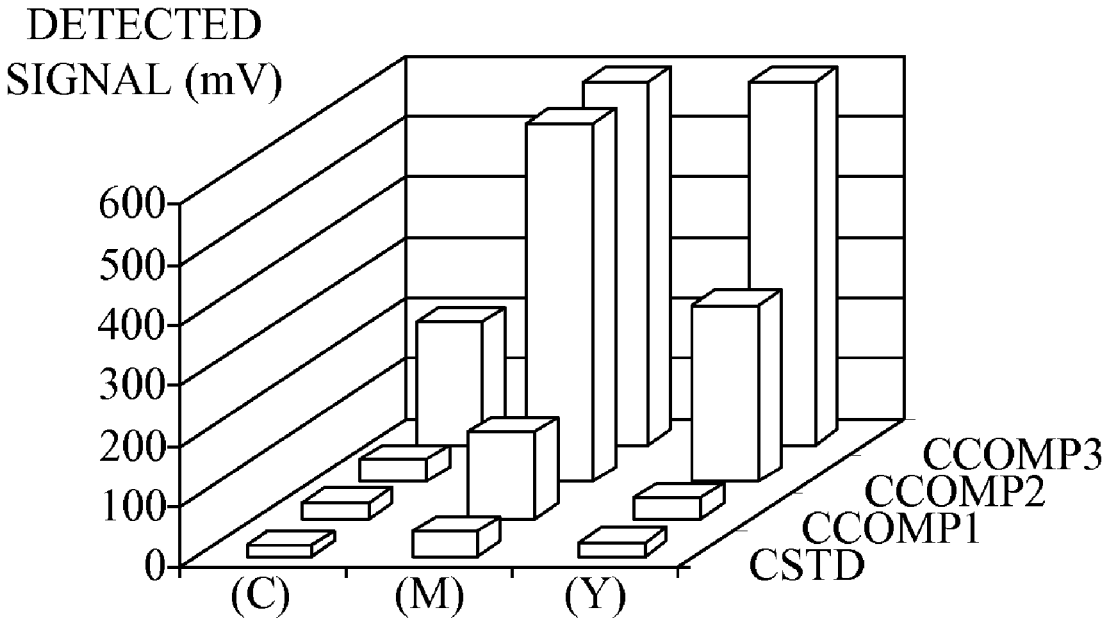
FIG. 6 is a graph showing the voltage output of a sensor of the ink detection device of FIG. 3 as a result of a comparison test using four color ink tank sets representing each of a cyan ink tank, a magenta ink tank and a yellow ink tank respectively filled with the same ink formulations as in FIG. 5, but with each of the ink tanks containing an ink suspension foam, and the ink detection device using a different set of light filters.

Referring to FIGS. 3 and 6, the fluorescent emission of the ink sets CSTD, CCOMP1, CCOMP2 and CCOMP3 in the respective ink tanks 34-2, 34-3 and 34-4 including a respective transparent portion 44-2, 44-3, 44-4 was measured as a voltage signal from sensor 58 of color detection units 50-2, 50-3, and 50-4, respectively (e.g., a photo detector diode). In the present example, the selected light filter for each of light filters 60-2, 60-3 and 60-4 of color detection units 50-2, 50-3 and 50-4 was a red filter. The average voltage readings (in millivolts (mV), +/− about 5 percent in multiple samples) represent the existence of fluorescent materials in the color inks. As shown in FIG. 6, higher amounts of fluorescent material in the inks give higher voltage readings.

As such, with the present invention, an ink may be identified by including a fluorescent material in the ink. Also, ink discrimination between inks of the same color, or as between inks of different color, may be made by varying the amount of fluorescent material added to the ink.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink identification and detection system comprising: an imaging apparatus; an ink tank mounted to said imaging apparatus, said ink tank having a transparent portion; an ink contained in said ink tank, said ink including a fluorescing material; a controller and an ink detection device communicatively coupled to said controller said ink detection device being configured to emit light in a non-visible spectrum of light through said transparent portion to said ink, and configured to detect light in a visible or near-infrared spectrum of light emitted through said transparent portion by said fluorescing material in said ink, said ink detection device supplying a signal representing the detected light to said controller for identifying said ink.

2. The system of claim 1, wherein said ink detection device includes at least one detection unit, each said detection unit including: a light source for emitting said light in the non-visible spectrum of light; a light filter for filtering said light in the visible or near-IR spectrum of light prior to detection; and a sensor for detecting said light in the visible or near-IR spectrum of light after filtering by said light filter.

3. The system of claim 2, wherein a color of said light filter is selected based on a color of said light emitted by said fluorescing material.

4. The system of claim 3, wherein said color filter is one of a green filter, a red filter, a yellow filter, and a blue filter.

5. The system of claim 1, wherein said light in the non-visible spectrum of light has a wavelength below about 400 nanometers and said light in the visible or near-infrared spectrum of light has a wavelength in a range of about 400 nanometers to 1000 nanometers.

6. The system of claim 1, wherein said ink is one of a monochrome ink and a color ink.

7. The system of claim 1, wherein said fluorescing material is an organic fluorescent dye or pigment selected from a group consisting of derivatives of benzoxazine and benzoxazinone.

8. The system of claim 1, wherein said fluorescing material is an organic fluorescent dye or pigment selected from a group consisting of complexes of rare earth elements with ligands containing beta, Diketones.

9. The system of claim 1, wherein said fluorescing material is an invisible ultraviolet fluorescent colorant.

10. The system of claim 9, wherein said invisible ultraviolet fluorescent colorant is selected from a group consisting of fluorescent derivatives of dansyl chloride, coumarin, carbocyanine, naphthalamide, stilbene, squarine, perylene, xanthene, thioxanthene, thioindigoid, acridine, and anthrapyridone dyes and pigments.

11. The system of claim 1, wherein said imaging apparatus mounts a plurality of ink tanks, and said ink detection device including a plurality of detection units respectively associated with said plurality of ink tanks for use in identifying inks contained in said plurality of ink tanks.

12. An imaging apparatus comprising: a print engine configured to mount at least one ink tank; a controller communicatively coupled to said print engine; and an ink detection device communicatively coupled to said controller, said ink detection device being configured to detect light in a visible or near-infrared spectrum of light emitted by a fluorescing material in ink said ink detection device supplying a signal representing the detected light to said controller for identifying said ink.

13. The imaging apparatus of claim 12, wherein said ink detection device includes at least one detection unit, each said detection unit including: a light source for emitting light in a non-visible spectrum of light; a color filter for filtering said light in the visible or near-IR spectrum of light prior to detection; and a sensor for detecting said light in the visible or near-IR spectrum of light after filtering by said color filter.

14. The imaging apparatus of claim 13, wherein said light in the non-visible spectrum of light has a wavelength below about 400 nanometers and said light in the visible or near-infrared spectrum of light has a wavelength in a range of about 400 nanometers to 1000 nanometers.

* * * * *